US008604699B2

(12) United States Patent
Kotowski et al.

(10) Patent No.: US 8,604,699 B2
(45) Date of Patent: Dec. 10, 2013

(54) SELF-POWER FOR DEVICE DRIVER

(75) Inventors: Jeff Kotowski, Nevada City, CA (US); Timothy James Herklots, Cupertino, CA (US); Charles Cai, San Jose, CA (US)

(73) Assignee: Atmel Corporation, San Jose, CA (US)

( * ) Notice: Subject to any disclaimer, the term of this patent is extended or adjusted under 35 U.S.C. 154(b) by 143 days.

(21) Appl. No.: 13/314,069

(22) Filed: Dec. 7, 2011

(65) Prior Publication Data

US 2013/0147358 A1 Jun. 13, 2013

(51) Int. Cl.
*H05B 37/02* (2006.01)

(52) U.S. Cl.
USPC ..... 315/122; 315/297; 315/307; 315/193

(58) Field of Classification Search
USPC ..... 315/193, 122, 186, 185 R, 291, 307, 279
See application file for complete search history.

(56) References Cited

U.S. PATENT DOCUMENTS 7,911,441 B2 * 3/2011 Chao et al. ..... 345/102
7,919,928 B2 * 4/2011 Ziegenfuss ..... 315/227 R
8,044,608 B2 * 10/2011 Kuo et al. ..... 315/291
8,054,008 B2 11/2011 Kimura
8,076,867 B2 * 12/2011 Kuo et al. ..... 315/291
8,148,919 B2 * 4/2012 Liu et al. ..... 315/307
8,217,587 B2 * 7/2012 Sauerlaender ..... 315/291
8,378,588 B2 * 2/2013 Kuo et al. ..... 315/291
2008/0150877 A1 * 6/2008 Chao et al. ..... 345/102
2011/0128303 A1 6/2011 Yonemaru et al.
2012/0032613 A1 * 2/2012 Liu et al. ..... 315/297
2012/0249005 A1 10/2012 Jin et al.
2013/0082621 A1 4/2013 Kotowski et al.
2013/0113381 A1 5/2013 Cai et al.

* cited by examiner

*Primary Examiner* — Vibol Tan
(74) *Attorney, Agent, or Firm* — Fish & Richardson P.C.

(57) ABSTRACT

The disclosed implementations utilize the voltage drop inherent in the device string to power a device control IC. In some implementations, current is drawn from the bottom of the device string and applied to a voltage supply pin of the device control IC. In some implementations, current is drawn from some other location in the device string (e.g., near the bottom or midpoint of the device string) using a switch. In some implementations, current is drawn from near the bottom and the bottom of the device string at different times, such that less current is drawn from the bottom of the device string as the duty cycle of the device string increases and more current is drawn from near the bottom of the device string as the duty cycle of the device string increases.

15 Claims, 3 Drawing Sheets

SELF-POWER FOR DEVICE DRIVER

TECHNICAL FIELD

This disclosure relates generally to electronics and more particularly to Light Emitting Diode (LED) backlight and LED lighting.

BACKGROUND

In modern displays, white LEDs are used to create the white light used to backlight the LCD. It is desirable to have the ability to vary the level of the backlight used. This is desired for both maximizing contrast as well as adjusting the display to the ambient light level. Conventional LED driver circuits accomplish dimming by adjusting the on time (duty cycle) of an LED string, such that the percentage of on time creates an equivalent brightness (or average intensity) at the desired brightness.

Some LED driver circuits include an integrated circuit (IC) for controlling LED string current. LED strings typically require higher voltages than the IC to control the LED string current. For example, in a typical application an LED control IC might run from 12 volts, while the LED string might run from 40 volts. Linear circuits can be used to generate the proper voltage for the IC, such as a simple or active shunt circuit or a shunt with an external NMOS. However, these circuits can add costs, die area and components.

SUMMARY

The disclosed implementations utilize the voltage drop inherent in the device string to power a device controller IC in a driver for illuminating elements (e.g., LEDs). In some implementations, current is drawn from the bottom of the device string and applied to a voltage supply pin of the device controller IC. In some implementations, current is drawn from somewhere other than the bottom of the device string (e.g., near the bottom or midpoint of the device string) using a switch, where the location for tapping the voltage depends on the desired voltage level. In some implementations, current is drawn from near the bottom and the bottom of the device string at different times, such that less current is drawn from the bottom of the device string as the duty cycle of the device string increases and more current is drawn from near the bottom of the device string as the duty cycle of the device string increases.

Particular implementations of a self-powered device driver can provide several advantages, including but not limited to: 1) low cost, 2) minimal components and 3) high efficiency.

The details of one or more disclosed implementations are set forth in the accompanying drawings and the description below. Other features, aspects, and advantages will become apparent from the description, the drawings and the claims.

DETAILED DESCRIPTION

Exemplary Circuits

Overview of Device Driver

Figure 1:
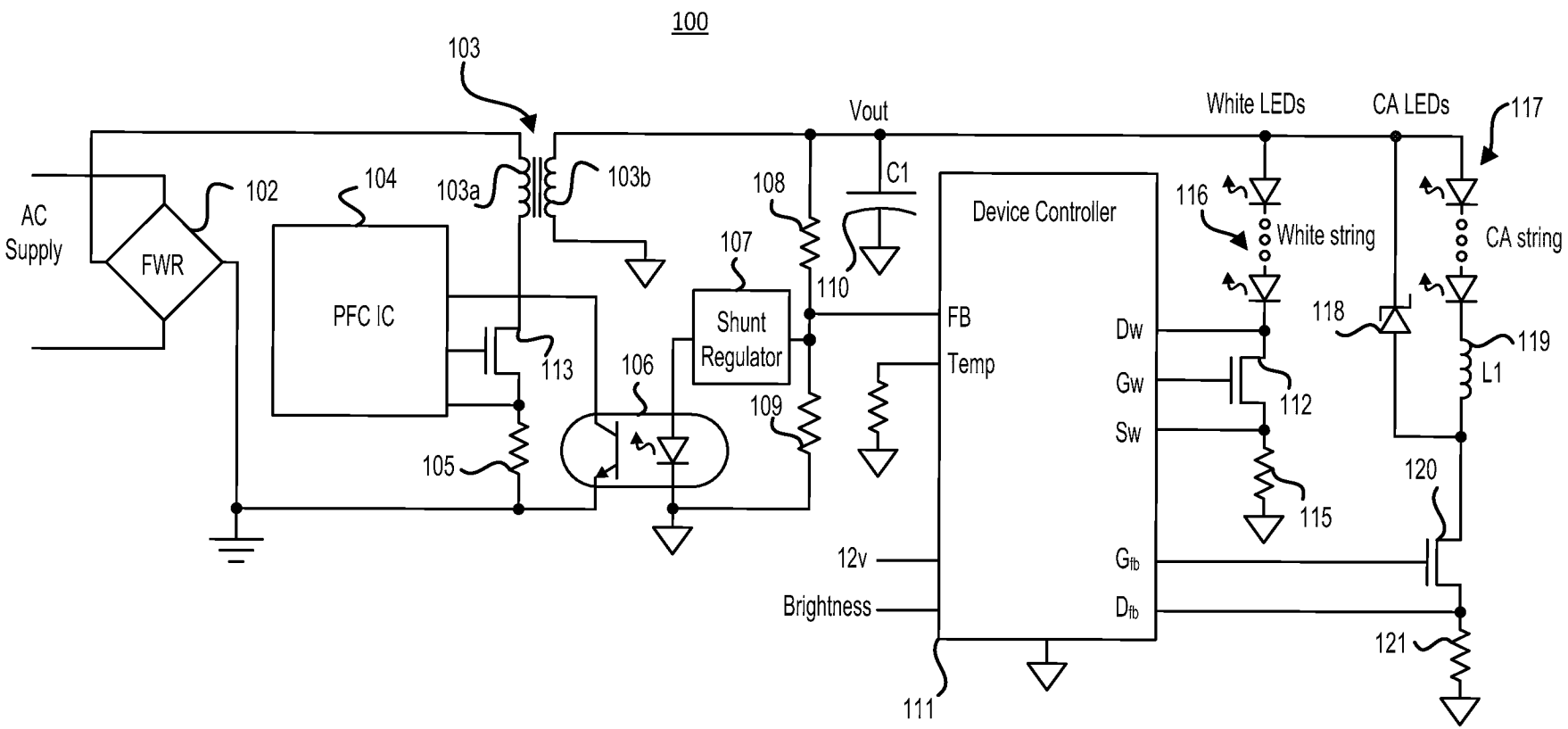
FIG. 1 is a simplified schematic diagram of an exemplary color correcting device driver for driving lighting elements with constant current.

FIG. 1 is a simplified schematic diagram of a color correcting device driver 100 for driving illuminating elements (e.g., LEDs) with constant current. In some implementations, device driver 100 can include full-wave rectifier (FWR) 102, power factor corrector (PFC) controller 104, transformer 103 (having primary coil 103*a* and secondary coil 103*b*), transistor 113, sense resistor 105, opto-coupler 106, shunt regulator 107, resistors 108, 109, capacitor 110 (C1), device controller 111, transistor 112, sense resistor 115, white string 116, CA string 117, recirculating diode 118, inductor 119 (L1), transistor 120 and sense resistor 121.

The number of strings 116, as well as the number of elements in each string, may depend on the particular type of device and application. For example, the device driver technology described here can be used, for example, in backlighting and solid-state lighting applications. Examples of such applications include LCD TVs, PC monitors, specialty panels (e.g., in industrial, military, medical, or avionics applications) and general illumination for commercial, residential, industrial and government applications. The device driver technology described here can be used in other applications as well, including backlighting for various handheld devices. The device driver 100 can be implemented as an integrated circuit fabricated, for example, on a silicon or other semiconductor substrate.

An AC input voltage (e.g., sinusoidal voltage) is input to FWR 102, which provides a rectified AC voltage. PFC controller 104 is configured to convert the rectified AC voltage on the primary side of transformer 103 to a DC voltage (Vout) on the secondary side of transformer 103, for driving strings 116, 117. PFC controller 104, together with transistor 113 and sense resistor 105 assures that the current drawn by transformer primary winding 103*a* (and hence the AC supply) is in the correct phase with the AC input voltage waveform to obtain a power factor as close as possible to unity. By making the power-factor as close to unity as possible the reactive power consumption of strings 116, 117 approaches zero, thus enabling the power company to deliver efficiently electrical power from the AC input voltage to strings 116, 117.

Capacitor 110 compensates for the current supplied by PFC controller 104 by holding a DC voltage within relatively small variations (low ripple) while the load current is approximately DC and the current into capacitor 110 is at twice the frequency of the AC input voltage. When the AC input voltage is zero, the current in secondary coil 103*b* goes to zero and capacitor 110 provides the current for strings 116, 117. To keep the DC ripple low, a large electrolytic capacitor often is used, which can be unreliable, costly and have a limited life span.

Resistors 108, 109 form a voltage divider network for dividing down Vout before it is input to the feedback (FB) node of device controller 111 and shunt regulator 107. Device controller 111 forces current out of the FB node to regulate node Dw at a desired voltage level (typically 1V). Shunt regulator 107 acts as a reference for the feedback loop and provides current to opto-coupler 106. Recirculating diode 118 (e.g., a Schottky diode) recirculates current from CA string 117 when the PWM on the gate of transistor 120 is turned off.

In the circuit configuration shown, white string 116 uses most of the power CA string 117 uses a smaller amount of power to fill in the color spectrum. For example, white string 116 may require approximately 40 volts and 350 mA (14 watts), while CA string 117 requires approximately 20V and 150 mA (3 watts).

Device controller 111 resides on the secondary side of transformer 103. Device controller 111 is coupled to the drain, gate and source terminals of transistor 112 through nodes Dw, Gw and Sw. Device controller 111 is further coupled to the drain and source terminals of transistor 120. Device controller 111 sets the voltage and current through white string 116 by commanding transistor 112 (e.g., MOSFET transistor) on and off using a PWM waveform (e.g., applied to the gate of transistor 112 through node Gw) with a suitable duty cycle. The current is set by an amplifier loop in device controller 111 (not shown) by controlling the voltage across sense resistor 115. The voltage across white string 116 is controlled by measuring the drain voltage (Dw) of white string 116 and feeding back a current into the feedback node (FB) such that the drive (transistor 112 and sensor resistor 115) has just enough headroom to supply the required continuous current to strings 116, 117.

Similarly, device controller 111 sets the voltage and current through CA string 117 by commanding transistor 120 (e.g., MOSFET transistor) on and off using a PWM waveform (e.g., applied to the gate of transistor 120 through node Gfb) having a suitable duty cycle. The current is set by an amplifier loop in device controller 111 (not shown) by controlling the voltage across sense resistor 121. The voltage across CA string 117 is controlled by measuring the drain voltage (Dw) of CA string 117 at node Dfb. Since CA string 117 has a lower voltage than white string 116, a floating buck configuration can be used to regulate the current in inductor 119 (L1) to regulate the current in CA string 117. Internal to device controller 111 is a look-up table for adjusting CA string 117 brightness as a function of temperature.

In device driver 100, device controller 111 is powered by a 12V input supply (not shown). This power supply can be provided by a voltage regulator circuit (e.g., a passive or active shunt circuit). In other implementations, the power supply (hereafter referred to as "Vsupply") can be provided by string 116, as described in reference to FIG. 2.

Example Self-Power Configurations

Figure 2:
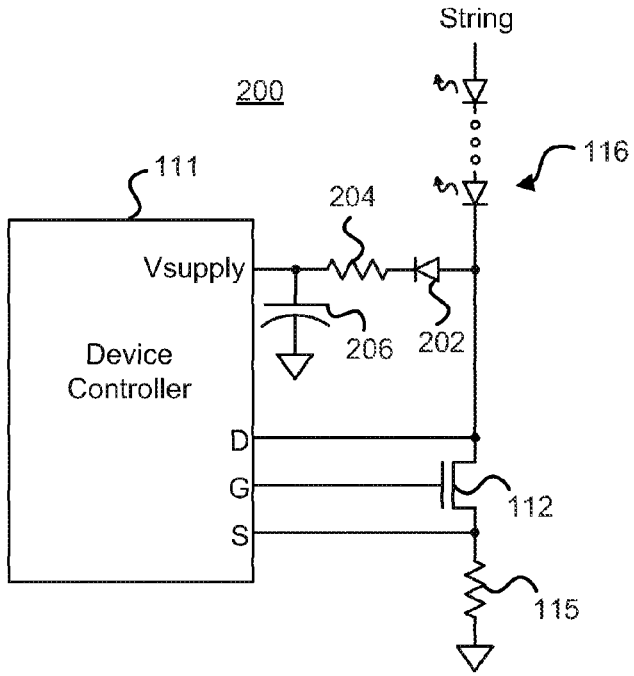
FIG. 2 is a simplified schematic diagram of the secondary side of the driver of FIG. 1, where the device controller IC is powered from the bottom of the device string.

FIG. 2 is a simplified schematic diagram of the secondary side of device driver 100 of FIG. 1, where device controller IC 111 is powered from the bottom of device string 116. In some implementations, the bottom of string 116 is coupled to Vsupply through diode 202 and resistor 204. Capacitor 206 is coupled in parallel with resistor 204. When light emitting elements (e.g., LEDs) in string 116 forward conduct, current flows through diode 202 and resistor 204, causing a voltage drop across resistor 204, which is input to the Vsupply pin of device controller 111. Additionally, charge is stored on capacitor 206, when string 116 is off, capacitor 206 will provide supply voltage to device controller 111. Additional circuitry (not shown) can be included in controller IC 102 for creating the voltage supply "Vsupply." For example, a simple passive or active shunt circuit or Zener diode can be coupled internally to the Vsupply pin of device controller 111.

Even though the device string voltage supply (Vout) is roughly 40V, the bottom of device string is only 40V at zero current. Even the smallest current through the device string creates a significant voltage drop. This voltage drop can be used to create the low voltage supply for device controller 111. For example, drawing just 3.5 mA from string 116 (when string 116 is off) will cause roughly 30V drop across string 116. This drop comes for free (meaning 100% efficiency) as it is converted to light, which is desired. Obtaining the current from the 350 mA string 116, results in less than 1% error in, for example, the LED brightness as 3.5 mA is 1% of the 350 mA in string 116. This error can be reduced by shifting the pulse width modulation (PWM) cycle provided by device controller 111. Using current from string 116 to power device controller 111 creates a supply with reasonably high efficiency.

Figure 3:
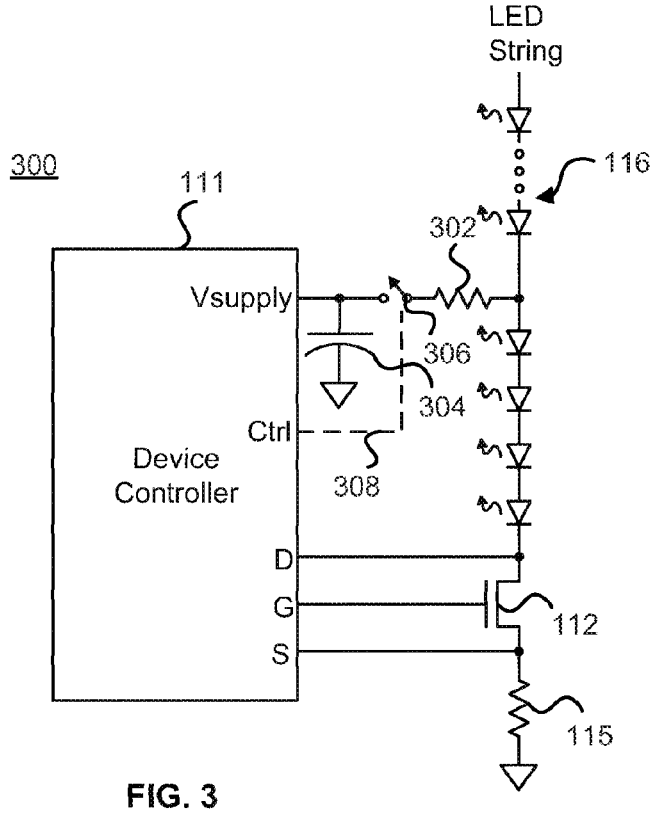
FIG. 3 is a simplified schematic diagram of the secondary side of the driver of FIG. 1, where the device controller IC is powered from near the bottom (e.g., the midpoint) of the device string.

FIG. 3 is a simplified schematic diagram of the secondary side of the device driver 100 of FIG. 1, where the device controller 111 is powered near the bottom (e.g., midpoint) of device string 116. Generally, the supply voltage for device controller 111 can be tapped across a desired number of light emitting elements in string 116 to achieve the desired voltage level. The configuration of FIG. 3 is similar to the configuration of FIG. 2, except diode 202 is removed and switch 306 has been added. Switch 306 can be controlled through a control node 308 (Ctrl) of device controller 111 or by another component (e.g., a microcontroller, logic).

In the configuration of FIG. 3, power is pulled from near the bottom of string 116 (e.g., from the midpoint of string 116) when string 116 is on. For example, each light emitting element (e.g., LED) has a forward voltage of 3V at 350 mA, tapping the fourth light emitting element in string 116 will provide access to roughly 12V. This approach offers a well-controlled voltage to power device controller 111.

In some implementations, it may be desirable to use both configurations described in FIGS. 2 and 3 in a "hybrid" configuration. In the "hybrid" configuration, current can be drawn near the bottom and the bottom of string 116 at different times, such that less current is drawn from the bottom of string 116 as the duty cycle of string 116 increases and more current is drawn from near the bottom (e.g., midpoint) of string 116 as the duty cycle of string 116 increases. The configuration in FIG. 2 can be used to start up the device driver 100.

Figure 4:
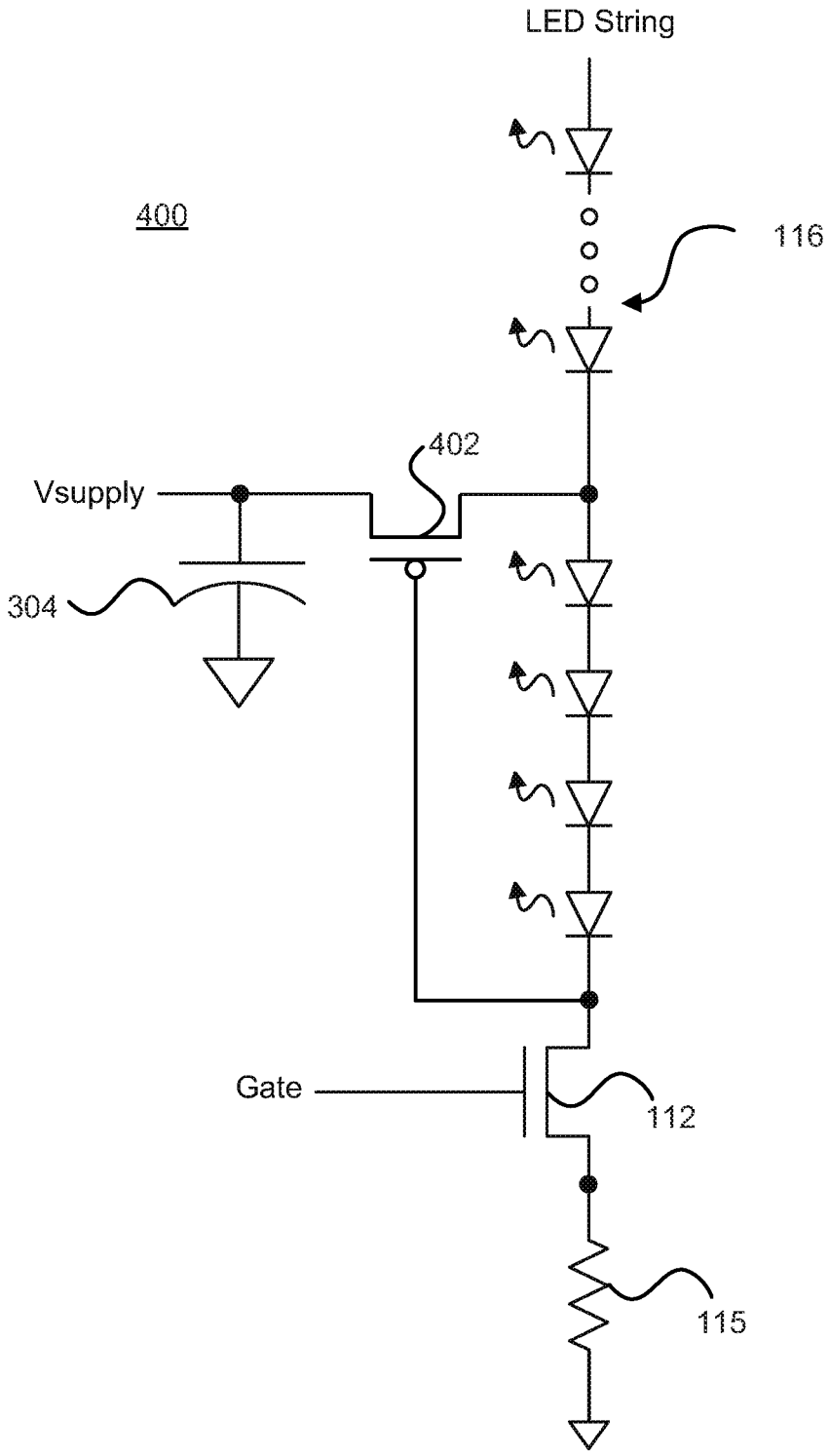
FIG. 4 is a simplified schematic diagram of the secondary side of the driver of FIG. 1, further illustrating the switch control in FIG. 3.

FIG. 4 is a simplified schematic diagram of the secondary side of the driver of FIG. 1, further illustrating the control of switch 306 in FIG. 3. Transistor 402 (switch 306) is biased on only when transistor 112 is biased on, for example, by device controller 111. For example, transistor 112 can be commanded on by a voltage being applied to its gate by device controller 111. When transistor 112 is biased on, a voltage bias is set on the gate of transistor 402, turning transistor 402 on and allowing current to flow into capacitor 304.

While this document contains many specific implementation details, these should not be construed as limitations on the scope what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

What is claimed is:

1. A circuit for driving a string of light emitting elements, comprising:

an integrated circuit (IC) chip configured to couple to the string of light emitting elements and to control current flow in the string of light emitting elements;

a diode coupled to a location in the string;

a resistor coupled in series with the diode and to a power supply input of the IC chip for supplying current drawn at the location in the string; and a capacitor coupled in parallel with the resistor and to the power supply input of the IC chip.

2. The circuit of claim 1, where the location is at the bottom of the string.

3. The circuit of claim 1, where the IC chip is configured to provide a shifted pulse width modulation (PWM) duty cycle.

4. The circuit of claim 1, where the location is at the midpoint of the string.

5. The circuit of claim 1, where the circuit is included in a device driver for driving the string of light emitting elements.

6. A circuit for driving a string of light emitting elements, comprising:

an integrated circuit (IC) chip configured to couple to the string of light emitting elements and to control current flow in the string of light emitting elements;

a resistor coupled to a location in the string;

a switch coupled in series with the resistor and to a power supply input of the IC chip for supplying current drawn at the location in the string, the switch configured to be controlled by the IC chip or other component; and a capacitor coupled in parallel with the resistor and to the power supply input of the IC chip.

7. The circuit of claim 6, where the location is at the bottom of the string.

8. The circuit of claim 6, wherein the IC chip is configured to provide a shifted pulse width modulation (PWM) duty cycle.

9. The circuit of claim 6, where the location is at the midpoint of the string.

10. The circuit of claim 6, where the circuit is included in a device driver for driving the string of light emitting elements.

11. A circuit for driving a string of light emitting elements, comprising:

an integrated circuit (IC) chip configured to couple to a first location in the string of light emitting elements and to control current flow in the string of light emitting elements;

a first switch coupled to a power supply input of the IC chip for supplying current drawn at the first location in the string;

a capacitor coupled in parallel with the first switch and to the power supply input of the IC chip; and a second switch coupled to the first switch and the IC, the second switch configured to be controlled by the IC chip or other component.

12. The circuit of claim 11, where the first location is at the bottom of the string.

13. The circuit of claim 11, where the first location is at a midpoint of the string.

14. The circuit of claim 11, where the IC chip is configured to control the first and second switches to draw current from the first location in the string and a second location in the string at different times based on a duty cycle of the string.

15. The circuit of claim 14, where the duty cycle of the string is determined by a shifted pulse width modulation (PWM) cycle provided by the IC chip.

* * * * *